US005775511A

United States Patent [19]

Stark

[11] Patent Number: 5,775,511

[45] Date of Patent: Jul. 7, 1998

[54] APPARATUS AND METHOD FOR UTILIZING A PACKAGE OF AN ARTICLE FOR SUPPORTING THE SAME

[76] Inventor: Ralph C. Stark, 220 Rummel Rd., Milford, N.J. 08848

[21] Appl. No.: 747,255

[22] Filed: Nov. 18, 1996

[51] Int. Cl.[6] ..... B65D 5/50

[52] U.S. Cl. ..... 206/760; 206/762; 206/45.24; 206/469

[58] Field of Search ..... 206/45.24, 461, 206/467, 469, 759, 760, 762, 764, 736

[56] References Cited

U.S. PATENT DOCUMENTS

| | | | |
|---|---|---|---|
| 3,093,244 | 6/1963 | Middleton, Jr. et al. | 206/461 |
| 3,371,777 | 3/1968 | Lilly | 206/469 |
| 3,472,368 | 10/1969 | Hellstrom | 206/469 |
| 3,685,649 | 8/1972 | Diehl | 206/45.24 |
| 4,210,239 | 7/1980 | Takahashi | 206/760 |
| 4,266,667 | 5/1981 | Ishigaki | 206/469 |
| 5,009,894 | 4/1991 | Hsiao | 206/469 |

OTHER PUBLICATIONS

Packaging and Merchandising Options, Techform Inc. Nov. 15, 1982.

*Primary Examiner*—David T. Fidei

[57] ABSTRACT

An apparatus and method for utilizing a package of an article for supporting the same including a backing with a perforation extending between side edges thereof. Further provided is at least one container including a front face, a rear face, and a periphery integrally coupled therebetween defining an interior space for storing articles therein. The rear face of the container is coupled to the cardboard backing such that a top extent of the container resides on one side of the perforation. Further, a bottom extent of the container resides on an opposite side of the perforation. The container also has a container perforation formed about the front face and the periphery thereof, wherein the container perforation resides in a plane in which the second perforation resides.

8 Claims, 2 Drawing Sheets

APPARATUS AND METHOD FOR UTILIZING A PACKAGE OF AN ARTICLE FOR SUPPORTING THE SAME

BACKGROUND OF THE INVENTION

1. Field of the Invention

The present invention relates to an apparatus and method for utilizing a package of an article for supporting the same and more particularly pertains to utilizing a package of tubes of glue as a stand for maintaining the tubes substantially upright.

2. Description of the Prior Art

The use of glue dispensers is known in the prior art. More specifically, glue dispensers heretofore devised and utilized for the purpose of dispensing glue are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,898,306 to Pardes; U.S. Pat. No. 4,984,712 to Jouillat; U.S. Pat. Des. No. 353,397 to Banik; U.S. Pat. No. 4,217,994 to Koenig et al.; U.S. Pat. No. 5,409,145 to Payne; and U.S. Pat. No. 5,263,615 to Anderson et al.

In this respect, the apparatus and method for utilizing a package of an article for supporting the same according to the present invention substantially departs from the conventional concepts and designs of the prior art, and in so doing provides an apparatus primarily developed for the purpose of utilizing a package of tubes of glue as a stand for maintaining the tubes substantially upright.

Therefore, it can be appreciated that there exists a continuing need for a new and improved apparatus and method for utilizing a package of an article for supporting the same which can be used for utilizing a package of tubes of glue as a stand for maintaining the tubes substantially upright. In this regard, the present invention substantially fulfills this need.

SUMMARY OF THE INVENTION

In view of the foregoing disadvantages inherent in the known types of glue dispensers now present in the prior art, the present invention provides an improved apparatus and method for utilizing a package of an article for supporting the same. As such, the general purpose of the present invention, which will be described subsequently in greater detail, is to provide a new and improved apparatus and method for utilizing a package of an article for supporting the same which has all the advantages of the prior art and none of the disadvantages.

To attain this, the present invention essentially comprises a cardboard backing with a thin rectangular configuration. The cardboard backing has a pair of long edges and a pair of short edges coupled therebetween. The cardboard backing has a first perforation extending between the long edges of the backing a distance ⅓ the length of the backing from a first short edge. A second perforation extends between the long edges of the backing a distance ⅔ the length of the backing from the first short edge. Further provided is a third perforation extending between the long edges of the backing adjacent a second edge of the cardboard backing. The third perforation has a short space without a perforation situated at a central extent thereof. Also included is an oval cut out situated adjacent the first short edge of the cardboard backing. As shown in FIG. 1, a pair of rectilinear containers are each constructed from a rigid transparent material in the group including plastic. Each container includes a front face, a rear face, and a periphery integrally coupled therebetween defining an interior space. As such, tubes of glue may be stored therein. Each container has a length ⅓ that of the long edges of the cardboard backing. The rear face of each of the containers is coupled to the cardboard backing such that a top extent of each container which is ¼ the length of each container resides between the first perforation and the first edge of the cardboard backing. See FIG. 1. A bottom extent of each container which is ¾ the length of each container resides between the first perforation and the second perforation of the cardboard backing. Each container further has a container perforation formed about the front face and the periphery thereof. It is imperative that the container perforation reside in a plane in which the second perforation resides.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved apparatus and method for utilizing a package of an article for supporting the same which has all the advantages of the prior art glue dispensers and none of the disadvantages.

It is another object of the present invention to provide a new and improved apparatus and method for utilizing a package of an article for supporting the same which may be easily and efficiently manufactured and marketed.

It is a further object of the present invention to provide a new and improved apparatus and method for utilizing a package of an article for supporting the same which is of a durable and reliable construction.

An even further object of the present invention is to provide a new and improved apparatus and method for utilizing a package of an article for supporting the same which is susceptible of a low cost of manufacture with regard to both materials and labor, and which accordingly is then susceptible of low prices of sale to the consuming public, thereby making such apparatus and method for utilizing a package of an article for supporting the same economically available to the buying public.

Still yet another object of the present invention is to provide a new and improved apparatus and method for utilizing a package of an article for supporting the same which provides in the apparatuses and methods of the prior art some of the advantages thereof, while simultaneously overcoming some of the disadvantages normally associated therewith.

Still another object of the present invention is to utilize a package of tubes of glue as a stand for maintaining the tubes substantially upright.

Another object of the present invention is to maintain a tube of glue upright when not in use to prevent the glue from overflowing when in use.

Lastly, it is an object of the present invention to provide a new and improved apparatus and method for utilizing a package of an article for supporting the same including a backing with a perforation extending between side edges thereof. Further provided is at least one container including a front face, a rear face, and a periphery integrally coupled therebetween defining an interior space for storing articles therein. The rear face of the container is coupled to the cardboard backing such that a top extent of the container resides on one side of the perforation. Further, a bottom extent of the container resides on an opposite side of the perforation. The container also has a container perforation formed about the front face and the periphery thereof, wherein the container perforation resides in a plane in which the second perforation resides.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
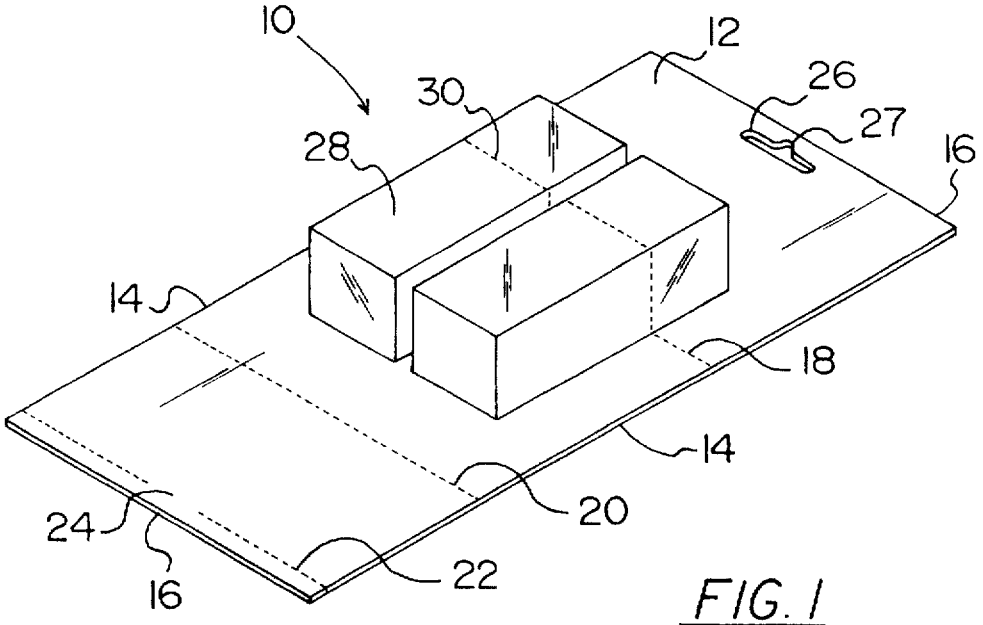
FIG. 1 is a perspective illustration of the preferred embodiment of the apparatus and method for utilizing a package of an article for supporting the same constructed in accordance with the principles of the present invention.

With reference now to the drawings, and in particular to FIG. 1 thereof, a new and improved apparatus and method for utilizing a package of an article for supporting the same embodying the principles and concepts of the present invention and generally designated by the reference numeral 10 will be described.

The present invention, the new and improved apparatus and method for utilizing a package of an article for supporting the same, is comprised of a plurality of components. Such components in their broadest context include a cardboard backing and a pair of containers. Such components are individually configured and correlated with respect to each other so as to attain the desired objective.

More specifically, it will be noted that the system 10 of the present invention includes a cardboard backing 12 with a thin rectangular configuration. The cardboard backing has a pair of long edges 14 and a pair of short edges 16 coupled therebetween. The cardboard backing has a first perforation 18 extending between the long edges thereof a distance ⅓ the length of the backing from a first short edge. A second perforation 20 extends between the long edges of the backing a distance ⅔ the length of the backing from the first short edge. Further provided is a third perforation 22 extending between the long edges of the backing adjacent a second edge of the cardboard backing. The third perforation ha s a short spac e 24 without a perforation situated at a central extent thereof. Also included is an oval cut out 26 situated adjacent the first short edge of the cardboard backing. Ideally, the oval cut out has a divot 27 formed in a top edge thereof for facilitating the hanging of the cardboard backing on a post.

As shown in FIG. 1, a pair of rectilinear containers 28 are each constructed from a rigid transparent material in the group including plastic. Each container includes a front face, an open rear face, and a periphery integrally coupled therebetween defining an interior space. As such, tubes of glue may be stored therein. Each container has a length ⅓ that of the long edges of the cardboard backing. The rear face of each of the containers is coupled to the cardboard backing such that a top extent of each container which is ¼ the length of each container resides between the first perforation and the first edge of the cardboard backing. See FIG. 1. A bottom extent of each container which is ¾ the length of each container resides between the first perforation and the second perforation of the cardboard backing. Each container further has a container perforation 30 formed about the front face and the periphery thereof. It is imperative that the container perforation reside in a plane in which the second perforation resides.

Figure 2:
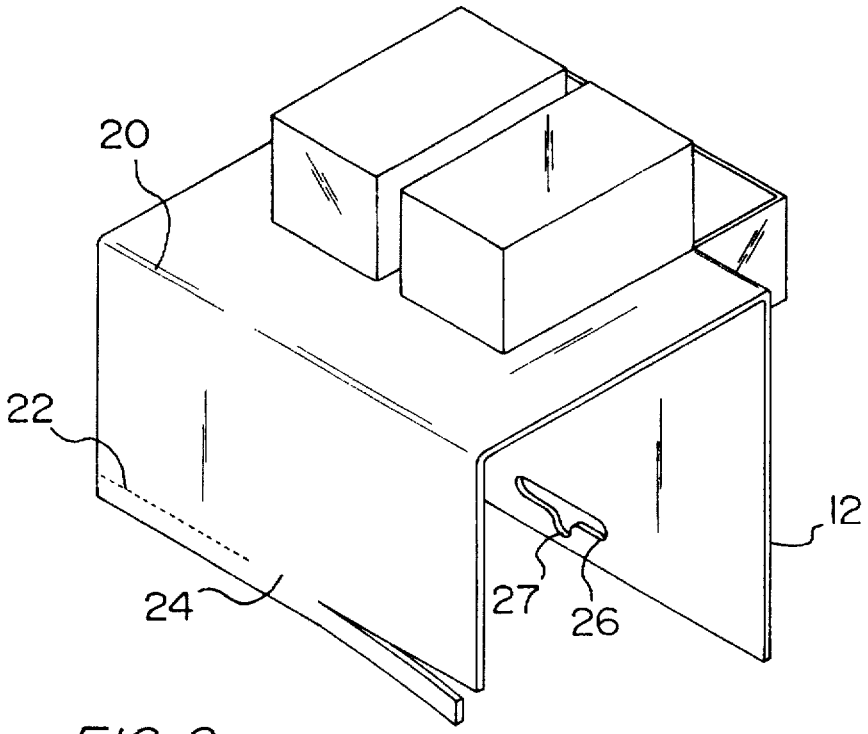
FIG. 2 is a perspective view of the present invention with the first and second perforations thereof bent and the container perforation separated
Figure 3:
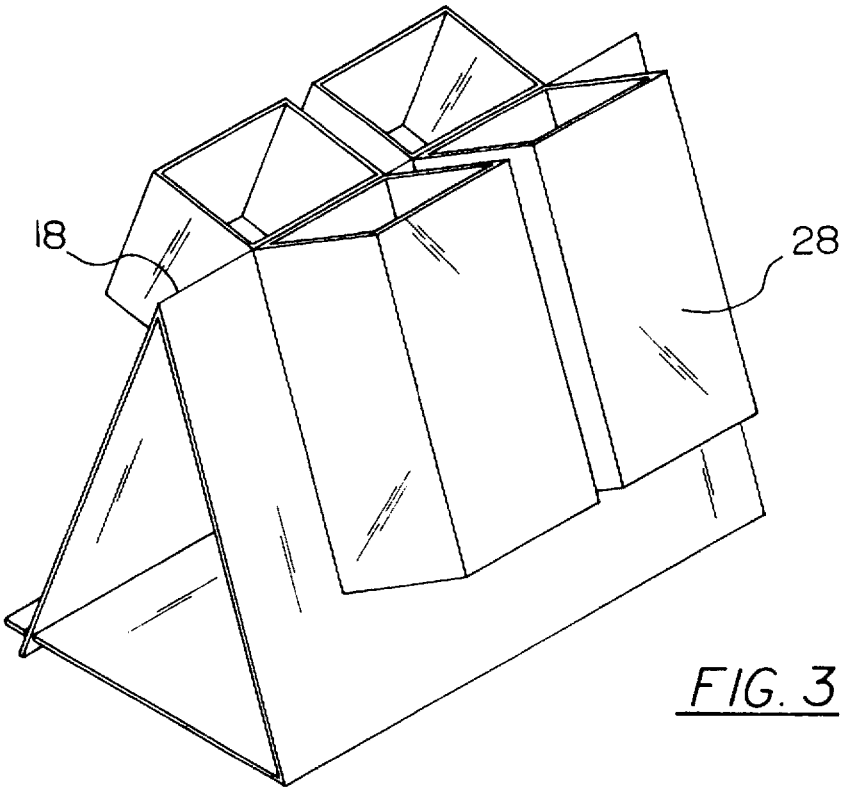
FIG. 3 is a perspective view of the present invention utilized as a stand for supporting tubes of glue.
Figure 4:
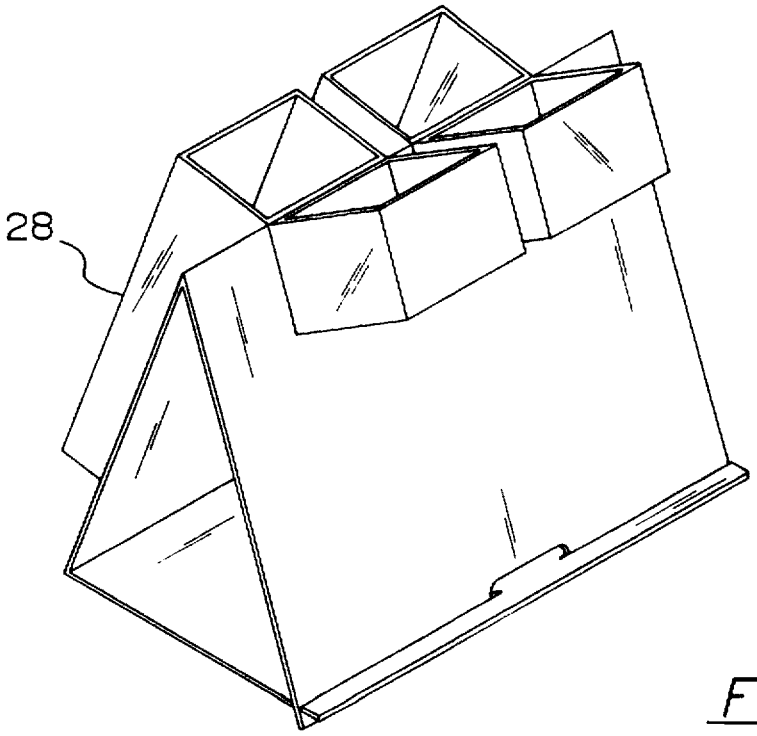
FIG. 4 is another perspective view of the present invention utilized as a stand for supporting tubes of glue.

The method associated with the present invention is first afforded by providing the foregoing components. After the present invention is utilized as a conventional package for tubes of glue in a store, the user may cut a majority of the third perforation to form a tab. Next, the user may bend the cardboard backing along the first perforation and second perforation thereof to form a triangle. It is important that the triangle be formed with the base angles thereof each forming at least 60 degrees. Thereafter, the tab is engaged within the oval cut out for maintaining the cardboard in the triangular configuration. See FIG. 4. Such may be accomplished by simply bending the strips of the tab so as to fit through the oval cut out. Next, the user may separate the containers along the container perforation to allow access to the tubes of glue therein. It should be noted that such step preferably occurs coincidentally with the step in which the first perforation is bent, as shown in FIG. 2. Finally, the tubes of glue may be stored within the bottom extent of the containers. Such upright storage is imperative in order to maintain the tubes of glue upright when not in use to prevent the glue from overflowing when in use. This phenomenon is quite common especially with super adhesive type glues which upon being maintained on there side for lengthy periods of time, exhibit an overflowing affect resulting from the glue accumulating adjacent an opening of the tube.

As to the manner of u sage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved apparatus for utilizing a package of an article for supporting the same comprising, in combination:

a cardboard backing with a thin rectangular configuration having a pair of long edges and a pair of short edges coupled therebetween, the cardboard backing having a first perforation extending between the long edges thereof a distance ⅓ the length of the backing from a first short edge, a second perforation extending between the long edges thereof a distance ⅔ the length of the backing from the first short edge, a third perforation extending between the long edges thereof adjacent a second edge of the cardboard backing with the exception of a short space situated at a central extent of the third perforation, an oval cut out situated adjacent the first short edge of the cardboard backing; and a pair of rectilinear containers each constructed from a rigid transparent material, each container including a front face, a rear face, and a periphery integrally coupled therebetween defining an interior space for storing tubes of glue therein, each container having a length ⅓ that of the long edges of the cardboard backing, the rear face of each of the containers coupled to the cardboard backing such that a top extent of each container which is ¼ the length of each container resides between the first perforation and the first edge of the cardboard backing and a bottom extent of each container which is ¾ the length of each container resides between the first perforation and the second perforation of the cardboard backing, each container further having a container perforation formed about the front face and the periphery thereof wherein the container perforation resides in a plane in which the second perforation resides;

whereby a user may cut a majority of the third perforation to form a tab, bend the cardboard backing along the first perforation and second perforation thereof to form a triangle, engage the tab within the oval cut out, further separate the containers along the container perforation to allow access to the tubes of glue therein, and allow storage of the tubes of glue within the bottom extent of the containers.

2. An apparatus for utilizing a package of an article for supporting the same comprising:

a backing with a perforation extending between side edges thereof; and at least one container including a front face, a rear face, and a periphery integrally coupled therebetween defining an interior space for storing articles therein, the rear face of the container coupled to the cardboard backing such that a top extent of the container resides on one side of the perforation and a bottom extent of the container resides on an opposite side of the perforation, the container further having a container perforation formed about the front face and the periphery thereof wherein the container perforation resides in a plane in which the second perforation resides;

wherein the backing has a thin rectangular configuration having a pair of long edges and a pair of short edges coupled therebetween and the first perforation extends between the long edges thereof a distance ⅓ the length of the backing from a first short edge, a second perforation extends between the long edges thereof a distance ⅔ the length of the backing from the first short edge, a third perforation extends between the long edges thereof adjacent a second edge of the cardboard backing with the exception of a short space situated at a central extent of the third perforation, and an oval cut out is situated adjacent the first short edge of the cardboard backing.

3. An apparatus for utilizing a package of an article for supporting the same as set forth in claim 2 wherein the backing is formed of cardboard.

4. An apparatus for utilizing a package of an article for supporting the same as set forth in claim 2 wherein two containers are included each constructed from a rigid transparent material, each container having a length ⅓ that of the long edges of the cardboard backing.

5. An apparatus for utilizing a package of an article for supporting the same as set forth in claim 2 wherein the rear face of each of the containers are coupled to the cardboard backing such that a top extent of each container which is ¼ the length of each container resides between the perforation and the first edge of the cardboard backing and a bottom extent of each container which is ¾ the length of each container resides between the first perforation and the second perforation of the cardboard backing.

6. An apparatus for utilizing a package of an article for supporting the same as set forth in claim 5 whereby a user may cut a majority of the third perforation to form a tab, bend the cardboard backing along the first perforation and second perforation thereof to form a triangle, engage the tab within the oval cut out, further separate the containers along the container perforation to allow access to the tubes of glue therein, and allow storage of the tubes of glue within the bottom extent of the containers.

7. An apparatus for utilizing a package of an article for supporting the same as set forth in claim 5 wherein the article is at least one tube of glue.

8. A new and improved method of utilizing package of tubes of glue for supporting the tubes during use, the method comprising the steps of:

providing a cardboard backing with a thin rectangular configuration having a pair of long edges and a pair of short edges coupled therebetween, the cardboard backing having a first perforation extending between the long edges thereof a distance ⅓ the length of the backing from a first short edge, a second perforation extending between the long edges thereof a distance ⅔ the length of the backing from the first short edge, a third perforation extending between the long edges thereof adjacent a second edge of the cardboard backing with the exception of a short space situated at a central extent of the third perforation, an oval cut out situated adjacent the first short edge of the cardboard backing;

providing a pair of rectilinear containers each constructed from a rigid transparent material in the group including plastic, each container including a front face, a rear face, and a periphery integrally coupled therebetween defining an interior space for storing tubes of glue therein, each container having a length ⅓ that of the long edges of the cardboard backing, the rear face of each of the containers coupled to the cardboard backing such that a top extent of each container which is ¼ the length of each container resides between the first perforation and the first edge of the cardboard backing and a bottom extent of each container which is ¾ the length of each container resides between the first perforation and the second perforation of the cardboard backing, each container further having a container perforation formed about the front face and the periphery thereof wherein the container perforation resides in a plane in which the second perforation resides;

cutting a majority of the third perforation to form a tab;

bending the cardboard backing along the first perforation and second perforation thereof to form a triangle with the base angles thereof each forming at least 60 degrees;

engaging the tab within the oval cut out for maintaining the cardboard in the triangular configuration;

separating the containers along the container perforation to allow access to the tubes of glue therein; and storing the tubes of glue within the bottom extent of the containers.

* * * * *